US006158417A

United States Patent [19]

Rauch et al.

[11] Patent Number: 6,158,417

[45] Date of Patent: Dec. 12, 2000

[54] THROTTLE BODY ACCOMODATION OF EITHER AN IDLE AIR CONTROL VALVE OR A MOTORIZED THROTTLE CONTROL

[75] Inventors: James Richard Rauch, Grass Lake; Matthew Jon Edwards, Ann Arbor, both of Mich.

[73] Assignee: Visteon Global Technologies, Inc., Dearborn, Mich.

[21] Appl. No.: 09/260,988

[22] Filed: Mar. 1, 1999

[51] Int. Cl.[7] ..... F02D 9/08

[52] U.S. Cl. ..... 123/399; 123/337

[58] Field of Search ..... 123/399, 337, 123/184.42, 184.52, 184.37, 184.45, 339.1, 339.24, 339.25; 251/305

[56] References Cited

U.S. PATENT DOCUMENTS

| | | | |
|---|---|---|---|
| 2,776,385 | 1/1957 | Modrey | 310/71 |
| 2,965,038 | 12/1960 | Purden et al. | 103/87 |
| 3,964,457 | 6/1976 | Coscica | 123/339.21 |
| 4,601,271 | 7/1986 | Ejiri et al. | 123/361 |
| 4,649,880 | 3/1987 | Asano et al. | 123/399 |
| 4,850,322 | 7/1989 | Uthoff et al. | 123/399 |
| 4,915,074 | 4/1990 | Arai | 123/399 |
| 5,063,899 | 11/1991 | Hitomi et al. | 123/336 |
| 5,081,978 | 1/1992 | Sumida et al. | 123/588 |
| 5,711,271 | 1/1998 | Schlagmueller et al. | 123/339.24 |
| 5,715,782 | 2/1998 | Elder | 123/184.61 |
| 5,746,177 | 5/1998 | Criss et al. | 123/337 |
| 5,794,591 | 8/1998 | Kalebjian et al. | 123/337 |
| 5,848,758 | 3/1999 | Fujita . | |
| 5,868,114 | 2/1999 | Kamimura et al. | 123/399 |
| 5,881,695 | 3/1999 | Apel | 123/337 |

FOREIGN PATENT DOCUMENTS

| | | |
|---|---|---|
| 2606115 A1 | 5/1988 | France . |
| 3641273 | 6/1987 | Germany . |
| 57-148045 | 9/1982 | Japan . |
| 58-172457 | 10/1983 | Japan . |
| 2-223662 | 9/1990 | Japan . |
| 4-00134139 | 5/1992 | Japan . |
| 9-02009852 | 8/1997 | Japan . |
| 11-002170 | 1/1999 | Japan . |
| 2202276 | 9/1988 | United Kingdom . |

*Primary Examiner*—Henry C. Yuen
*Assistant Examiner*—Hieu T. Vo
*Attorney, Agent, or Firm*—Rhonda McCoy-Pfau

[57] ABSTRACT

A throttle body (61) has a first body part (62) containing an upstream portion of the through-bore (68) and a second body part (64) containing a downstream portion of the through-bore. The two body parts are joined together to register the downstream portion of the through-bore as a continuation of the upstream portion at respective confronting faces of the two body parts, capturing at least one bearing assembly (94) of a throttle mechanism between the confronting faces to thereby journal a throttle shaft (72) on opposite wall portions of the throttle body. The two body parts also contain a by-pass air passage (114). In one form (FIGS. 1 and 2) an idle air control valve (58) associates with the by-pass passage; in another (FIGS. 3 and 4), an electric motor actuator (167) associates with the passage and with the throttle shaft.

18 Claims, 2 Drawing Sheets

THROTTLE BODY ACCOMODATION OF EITHER AN IDLE AIR CONTROL VALVE OR A MOTORIZED THROTTLE CONTROL

BACKGROUND OF THE INVENTION

1. Field of the Invention

This invention relates generally to throttles for controlling flow through intake systems of internal combustion engines, and more specifically to two forms of throttle bodies, one having both a mechanically actuated throttle blade and an idle air control valve, and the other having an electric motor actuator for the throttle blade.

2. Background Information, Including Reference To Related Patent Applications And Incorporation By Reference Spark-ignited, fuel-injected internal combustion engines enjoy extensive usage as the powerplants of automotive vehicles. A representative intake system for such an engine comprises a throttle body that has a through-bore within which a throttle blade, or throttle plate, also sometimes referred to as a butterfly, is disposed. The throttle blade is fastened to a cylindrical shaft whose axis is substantially coincident with a diameter of the through-bore. The shaft is journaled on opposite wall portions of the throttle body for motion about its own axis. An actuator that is external to the through-bore selectively positions the shaft about its own axis, to thereby selectively position the throttle blade within the through-bore over a range of positions spanning a closed throttle position and a full open throttle position.

One type of actuator for operating the throttle of an automotive vehicle is a strictly mechanical device that is direct operated by the driver's depressing of an accelerator pedal. For example, motion of the accelerator pedal may be transmitted through a sheathed cable to a lever, or cam, that is disposed on the throttle shaft external to the throttle through-bore. If that vehicle is also equipped with a cruise control system, the cruise control input is from a servo, or the like, which is remote from the throttle, but still cable-coupled to the throttle cam, or lever. The throttle body has a by-pass passage that parallels that portion of the through-bore containing the throttle blade. When the throttle blade is in closed position and the engine is idling, an idle air control valve meters intake air flow through the by-pass passage, thereby controlling the airflow into the engine past the closed throttle blade.

Another type of actuator is electromechanical in nature. An example is an electric (or electronic) throttle control, or ETC, in which the shaft of an electric motor is coupled to the throttle shaft through some form of coupling mechanism. The throttle blade is positioned by rotary motion of the motor shaft. The motor is itself controlled by an electronic controller, such as an engine management computer for example, in accordance with a signal from a sensor that is operated by the accelerator pedal. The controller essentially slaves the throttle to the pedal so that the blade is operated to a position corresponding to the position of the pedal. A cruise control system may be conveniently integrated with an electronic throttle control without a servo because of the presence of the electric motor that operates the throttle shaft. In known ETC systems, the motor is external to the throttle body and its shaft is coupled to the throttle shaft by a mechanical coupling. A gear train that provides gear reduction is one example of such a coupling.

Commonly owned, co-pending U.S. patent application Ser. No. 09/050,183 discloses a Clamshell Throttle Body Assembly. That throttle body comprises two body halves that meet face-to-face at a common mating plane that is perpendicular to a central longitudinal axis of the throttle body that coincides with that of a central circular through-bore of the throttle body. Before the two body halves are assembled together, a throttle mechanism comprising a circular throttle blade of uniform thickness disposed on a throttle shaft is placed between the two faces. As the two halves are moved together to place their mutually confronting faces on the common mating plane, circular bearing assemblies disposed on the shaft to either side of the blade become captured in shouldered circular apertures at diametrically opposite portions of the through-bore wall. As a result, the throttle blade is disposed within the through-bore for positioning about the shaft axis via low-friction journals on opposite wall portions of the through-bore.

Proximate the common mating plane, the through-bore wall comprises two generally semi-circular ledges, one in one throttle body half and the other in the other throttle body half. Each ledge is spaced from the common mating plane a distance essentially equal to one-half the thickness of the throttle blade. One ledge occupies essentially one semi-circumference of the throttle body, and the other, essentially an opposite semi-circumference. When the throttle blade is in closed position, it assumes an orientation that is perpendicular to the through-bore axis, with opposite semi-circular margins of its circular perimeter being disposed essentially flat against the opposite semi-circular ledges.

Other commonly-owned pending patent applications that relate to further improvements in Clamshell Throttle Body Assemblies are: THROTTLE BODY MODULE HAVING IMPROVED BLADE TO LEDGE SEALING Ser. No. 09/260,331, relating to improved sealing of a closed throttle blade to one of the two ledges in the throttle body through-bore; THROTTLE BODY MODULE HAVING IMPROVED FLUID TIGHTNESS Ser. No. 09/260,201, relating to novel gasket sealing between confronting faces of the two halves of the clamshell, including sealing proximate the bearing assemblies of the throttle mechanism; and INTEGRATED THROTTLE BODY AND INTAKE MANIFOLD SPACER MODULE Ser. No. 09/260,323, relating to certain constructional aspects of the module, its throttle body, and its throttle mechanism.

The entire content of each of the four other commonly owned pending applications mentioned above is expressly incorporated herein by reference as if fully disclosed herein.

SUMMARY OF THE INVENTION

The present invention relates to improvements in throttle bodies that allow one half of a clamshell to accommodate either of the above-mentioned forms of throttle bodies, namely one which has both a strictly mechanical actuator and an idle air control valve, and one which has an electric motor that operates the throttle blade, so that only the other half of the clamshell need be unique to each form of throttle body.

Other general and specific aspects will been set forth in the ensuing description and claims.

BRIEF DESCRIPTION OF THE DRAWINGS

The drawings that will now be briefly described are incorporated herein to illustrate a preferred embodiment of the invention and a best mode presently contemplated for carrying out the invention.

DESCRIPTION OF THE PREFERRED EMBODIMENT

Figure 1:
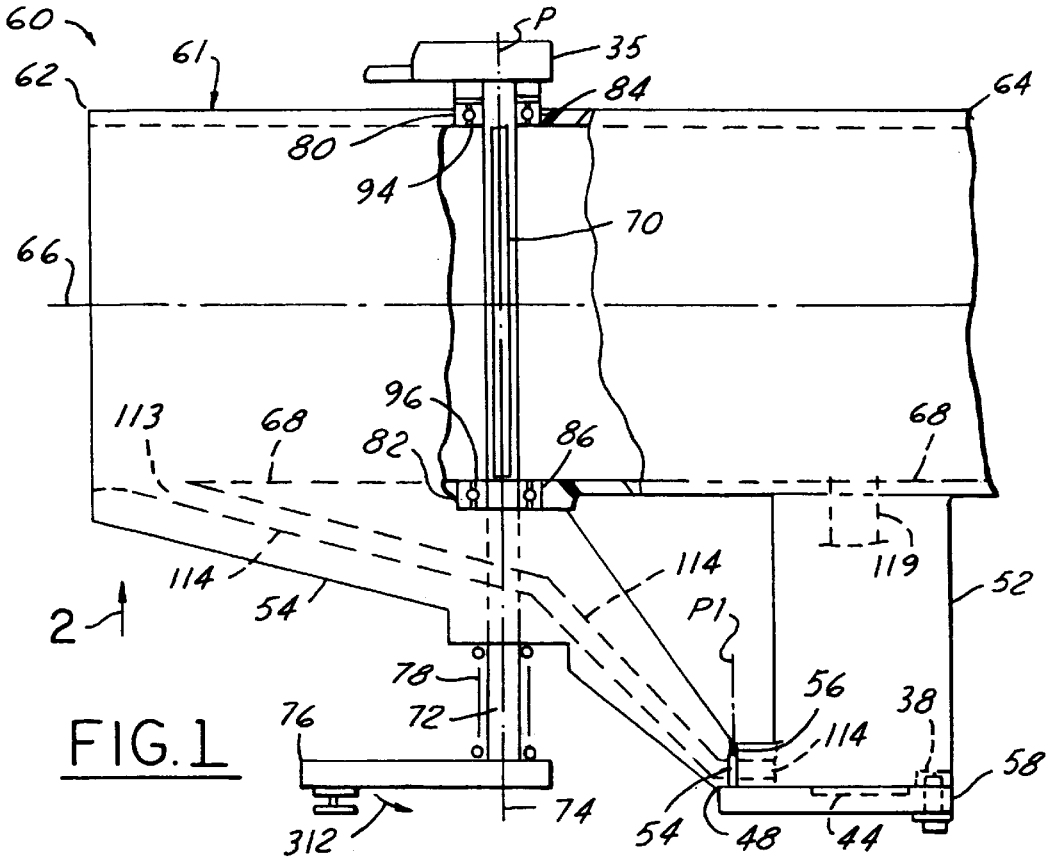
FIG. 1 is an elevation view, partly in section, of that portion of an example of a first form of throttle body pertaining to principles of the present invention.
Figure 2:
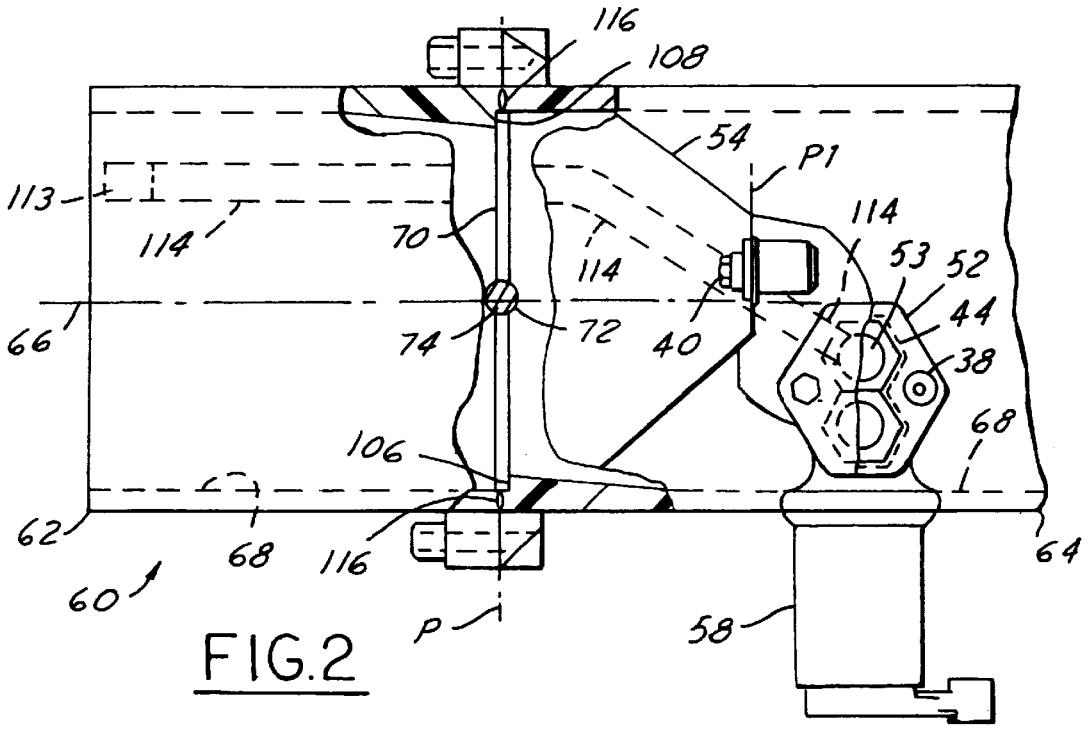
FIG. 2 is a view in the general direction of arrows 2—2 in FIG. 1, with portions broken away.

FIGS. 1 and 2 show a module 60 comprising a first form of throttle body 61 that embodies principles of the present invention. Module 60 comprises first and second body parts 62, 64, an air intake and a spacer respectively, that are disposed in succession along an imaginary central longitudinal axis 66. Body parts 62, 64 contain a through-bore 68 of nominally circular transverse cross section centered on axis 66. The through-bore is straight in air intake 62 and in the immediately adjoining portion of spacer 64 continuing from air intake 62. In a portion of spacer 64 not shown, it may make a right angle curve downward to end at a mounting flange for mounting on a engine that is also not shown.

A throttle mechanism comprising a throttle blade 70, alternatively sometimes referred to as a throttle plate or butterfly, is disposed within through-bore 68 and fastened to a cylindrical shaft 72 whose axis 74 is substantially coincident with a diameter of through-bore 68. Blade 70 is a circular disk of uniform thickness. Shaft 72 is journaled on opposite wall portions of throttle body 61 for motion about its own axis. Shaft 72 is operated by an actuator (not shown) that is operatively connected to a cam, or lever, 76 that is affixed to an external end of shaft 72. A double coiled torsion return spring 78 acts between the exterior of throttle body 61 and cam 76 to spring-bias shaft 72, and hence blade 70 as well, about axis 74 to a position that closes through-bore 68. When cam 76 is actuated against the spring bias to selectively position shaft 72 about axis 74, it selectively positions throttle blade 70 within through-bore 68. In this way, throttle blade 70 may be selectively positioned over a range of positions spanning a closed throttle position and a full open throttle position.

The portions of body parts 62 and 64 that circumscribe through-bore 68 meet face-to-face at a common mating plane P that is perpendicular to axis 66 and that contains axis 74. Parts 62 and 64 possess respective confronting faces at plane P. Formed in each of the two confronting faces of parts 62 and 64 in adjoining relation to through-bore 68 at each of opposite ends of a diameter of throttle body 61 that lies in the common mating plane, is one half of a respective circular aperture substantially centered on that diameter. Part 62 has half-apertures 80, 82, and part 64, half-apertures 84, 86. The two half-apertures 80, 84 thereby cooperatively form one complete circular aperture, while half-apertures 82, 86 form the other complete circular aperture. The two complete circular apertures are substantially diametrically opposite each other across through-bore 68.

Before air inlet 62 and spacer 64 are assembled together, a portion of the throttle mechanism that includes throttle blade 70, shaft 72, cam 76, and spring 78, as well as two circular annular bearing assemblies 94, 96, is placed between the two faces. Specifically, bearing assemblies 94, 96 are disposed on shaft 72 beyond the perimeter of throttle blade 70 for subsequent capture within the respective complete circular apertures, while throttle blade 70 is disposed for placement within through-bore 68. As parts 62, 64 are moved relative to one another to place their mutually confronting faces on plane P, half-apertures 80, 84 close on bearing assembly 94, and half-apertures 82, 86 close on bearing assembly 96. Bearing assemblies 94, 96 thereby become captured on the throttle body to provide stable, low-friction journaling of the throttle shaft and blade. Further detail may be found in other of the above-referenced patent applications.

Proximate the confronting faces of parts 62, 64 at plane P, the wall of through-bore 68 comprises two generally semi-circular ledges 106, 108, one in part 62 and the other in part 64. Each ledge 106, 108 is spaced from the common mating plane a distance essentially equal to one-half the thickness of throttle blade 70, with one ledge occupying essentially one semi-circumference of throttle body 61, and the other, essentially an opposite semi-circumference. The mounting of throttle blade 70 on shaft 72 is via a through-slot in that portion of shaft 72 which spans through-bore 68. The through-slot has a thickness that is just sufficient to allow throttle blade 70 to pass through and that is symmetric with respect to axis 74. Screws secure the attachment of blade 70 to shaft 72. Ledge 106 is spaced from plane P along the direction of axis 66, a distance equal to essentially one-half the throttle blade thickness. Ledge 106 occupies a planar surface that is flat and perpendicular to axis 66. When blade 70 is closed, its half that closes on ledge 106 assumes an orientation that is essentially perpendicular to axis 66 providing an essentially flush surface-to-surface sealing contact of the corresponding portion of its perimeter margin with ledge 106. While the same is also generally true for sealing of the opposite half to ledge 108, as described in application Ser. No. 09/050,183, a later discovery which is the subject of Ser. No. 09/260,331 has shown that certain sloping of ledge 108, as described therein, can yield an improvement in the sealing of the blade to that ledge.

In the operative throttle body, spring 78 is wound to impart a bias force that causes throttle blade 70 to be forcefully closed. The blade can be opened by applying an opposite force to cam 76, such as by an operating cable of a sheathed cable assembly (not shown) that pulls on the cam in the manner suggested by arrow 312 in FIG. 1.

Still further improvement in fluid tightness is achieved by the organization and arrangement of a gasket 116 that seals between parts 62 and 64 around through-bore 68. Detail of those further improvements involving gasket 116 may be found in patent application Ser. No. 09/260,201.

FIG. 1 also shows a throttle position sensor 35 which mounts externally on throttle body 61 over an end of shaft 72 opposite cam 76. Sensor 35 has an input shaft that turns with shaft 72 to cause the sensor to deliver an electric signal indicative of the instantaneous position to which throttle blade 70 is being operated. That signal may be used as an input to an electronic controller, such as an engine management computer.

Throttle body 61 includes an idle air by-pass passage 114 that by-passes throttle blade 70. An idle air control valve 58 mounted externally on throttle body 61 controls idle air flow through passage 114. While part 62 is constructed to have a main, generally cylindrical wall that circumscribes through-bore 68, it is also constructed with an integral arm 54 that, as depicted by FIGS. 1 and 2, extends from that main wall and terminates at a face 56 that is parallel to, but spaced downstream of, plane P.

An upstream portion of passage 114 is contained in part 62 and comprises an entrance 113 at the side wall of through-bore 68 so as to be open to that portion of the through-bore in part 62. From entrance 113, passage 114 runs internally through arm 54 to an exit 115 from part 62 at face 56.

Part 64 contains an arm 52 that associates with valve 58 and arm 54. Arm 52 is an integral formation of part 64 that projects generally radially outwardly from a main, generally cylindrical wall that circumscribes the portion of through-bore 68 which part 64 contains. A downstream portion of passage 114 is contained in part 64, running through arm 52. In arm 52, part 64 has a face 48 that is parallel to, and confronts, face 56 of part 62. The portion of passage 114 in part 64 has an entrance 50 at face 56. From entrance 50, passage 114 runs a short distance to intersect a cavity 53 in the outer end of arm 54. The passage continues through cavity 53 to an inlet port of idle air control valve 58. An outlet port of valve 58 registers with a hole 119 that extends through arm 52 back to through-bore 68.

When the confronting faces of parts 62 and 64 that circumscribe through-bore 68 come together at plane P, faces 56, 48 come together at a plane P1 spaced downstream from, but parallel to plane P. Hence, the upstream portion of passage 114 in part 62, and the downstream portion in part 64, meet at a common mating plane P1. A gasket 46 seals around passage 114 between faces 56, 48 at plane P1. One or more fasteners, such as 40, may be associated with parts 62, 64 proximate faces 56, 48 to secure a fluid-tight joint for passage 114 at plane P1.

Valve 58 comprises a flange that contains the valve's inlet and outlet ports. A gasket 44 is disposed between that flange and the radially outer end face of arm 52 to seal circumferentially around each port between the valve and the arm. The bodies of threaded metallic inserts 38 may be embedded in arm 52 to register with apertures in the valve flange to provide for threaded fasteners to secure the valve mounting on the throttle body in a manner that makes the joints between passage 114 and the valve's inlet and outlet ports fluid-tight.

Idle air control valve 58 is a known valve that is electrically controlled, such as by an engine management computer, to meter intake air flow at a controlled rate into the engine at idle when throttle blade 70 is in closed position. When valve 58 allows flow, air enters passage 114 at entrance 113, flows internally through arm 54, and into cavity 53, passing from part 62 into part 64 just prior to entering cavity 53. From there, air enters the valve inlet port, flows through the valve, and exits the valve outlet port at hole 119. The air then flows through hole 119 to re-enter through-bore 68.

Figure 3:
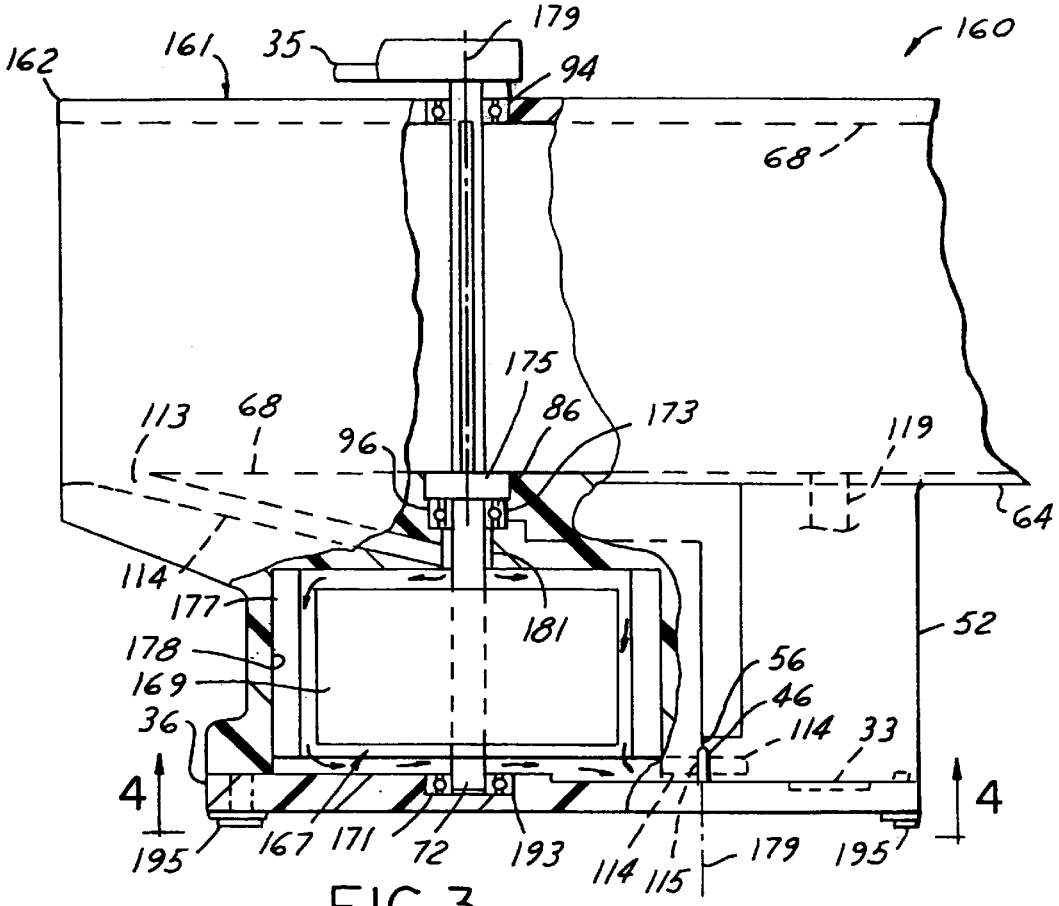
FIG. 3 is an elevation view, partly in section, of that portion of an example of a second form of throttle body pertaining to principles of the present invention.
Figure 4:
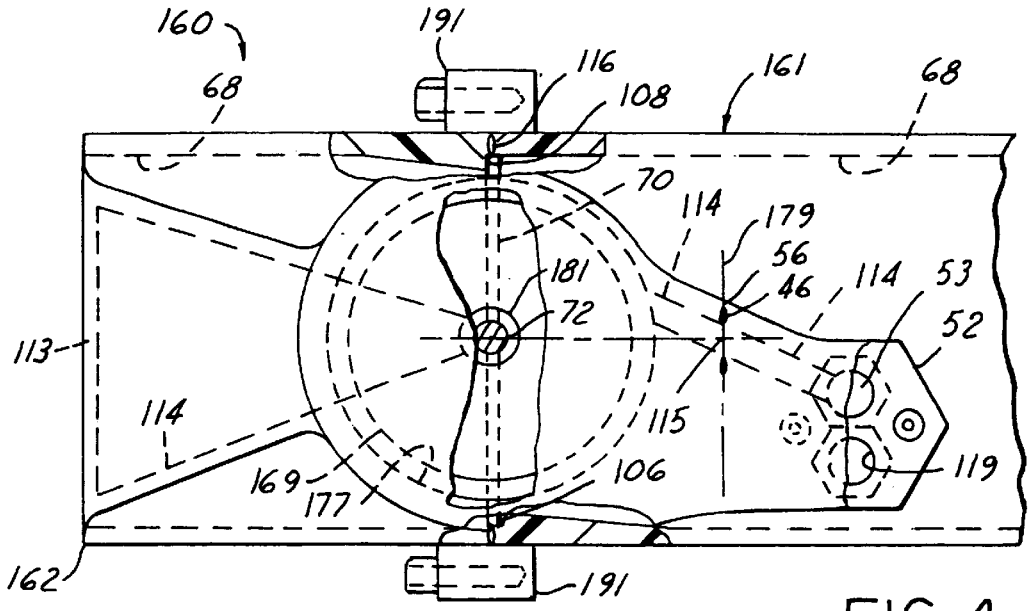
FIG. 4 is a view in the general direction of arrows 4—4 in FIG. 3, with portions broken away.

FIGS. 3 and 4 show that the same part 64 may be used in a second form of module 160 which comprises an ETC throttle body 161. Part 62 is however replaced by a different part 162. The same reference numerals that are applied to both modules 60, 160 identify like component parts, and therefore detailed description of certain parts may be omitted from the description of FIGS. 3 and 4 in the interest of brevity. While module 160 has an air passage 114 that by-passes throttle blade 70, it lacks an idle air control valve 58, and consequently passage 114 serves another purpose that will become more apparent as the description proceeds.

The actuator for throttle shaft 72 in module 160 comprises an electric motor, or electromechanical rotary actuator, 167 that is capable of accurately positioning throttle blade 70 over the latter's range of operative positions. Actuator 167 comprises an armature 169 affixed to shaft 72 external to through-bore 68. The throttle mechanism includes a third bearing assembly 171 for journaling shaft 72, such that it and bearing assembly 96 are to opposite sides of armature 169. Bearing assembly 96 is shown re-located from the position it assumed in module 60, being received in a counterbore 173 of part 162. The void in aperture 86 created by the re-location of bearing assembly 96 is filled by a plug 175 of like dimensions. Actuator 167 further comprises a stator 177 disposed within a suitably shaped, generally circular for example, cavity 178 of part 162.

A surface, or split line, at which confronting faces of parts 162 and 64 come together is designated by the numeral 179, but such a surface is not contained within a single flat plane. In the region of through-bore 68, split line 179 occupies a flat plane corresponding to plane P of FIGS. 1 and 2. FIG. 3 reveals that beyond that region, surface 179 is stepped. In the region of arm 52, split line 179 occupies a flat plane corresponding to plane P1 of FIGS. 1 and 2.

Within part 162, passage 114 runs from its entrance 113 to a clearance diameter 181 surrounding and spaced from shaft 72 to one side of armature 169 immediately interior of cavity 178. The passage tapers circumferentially inward as it approaches clearance diameter 181. Armature 169 has running clearance to stator 177. At the side of armature 169 opposite clearance diameter 181, passage 114 continues from cavity 178 to terminate in exit 115 at face 56 where it continues in part 64. Gasket 46 seals around the passage between the two parts 162, 64.

Because there is no idle air control valve, a cover plate 36 is disposed over the exterior of both parts 162 and 64 to enclose the motor and cover the outer end of arm 52. Where it covers arm 52, the inner face of cover plate 36 contains a shallow recess 33 that allows hole 119 to directly communicate with cavity 53.

During operation of module 160 with the engine running, passage 114 provides for air to flow through actuator 167, cooling the motor stator windings. The flow path extends from entrance 113 to clearance diameter 181 from whence air can pass axially (meaning parallel to axis 74) through the space that provides the running clearance between the armature and the stator. Once past the stator, air passes from part 162 through exit 115 and enters part 64, flowing into cavity 53. From there, air flows through recess 33 and hole 119 to re-enter through-bore 68.

Because of this ability to provide airflow cooling of the motor's internal mechanism, an ETC throttle body can use an electric motor that is relatively less efficient than alternative motors that are relatively more expensive because of their relatively higher efficiency. Heat that must be dissipated by the operation of a relatively less efficient electric motor is transferred to the by-pass airflow through the electric motor, ultimately dissipating the heat to the intake airflow into the engine.

Another advantage of application of an ETC system to a clam-shell type throttle body, as disclosed herein, is that the ETC electric motor and the throttle blade can share a common shaft. Hence, there is no need for coupling a separate electric motor shaft to a separate throttle shaft. Therefore, module 160 is believed to possess significant cost, manufacturing, and functional advantages without sacrificing performance.

A method of assembling the various parts of module 160 will now be described. Because of the nature of split line 179, the circular aperture within which bearing assembly 96 is disposed is wholly contained in part 162. So is the clearance diameter 181, which extends coaxially between that circular aperture and cavity 178. However, one half of the circular aperture that contains plug 175 is in part 162 while the other half is in part 64. Therefore, throttle blade 70 is attached to shaft 72 only after the shaft has been passed through the full circular apertures in part 162 that have just been described.

Bearing assembly 96 is loaded into its receiving aperture in part 162 from the end of that aperture which is toward through-bore 68. The outer race of the bearing assembly is pressed into that aperture and against a shoulder where the aperture adjoins clearance diameter 181. The inner races of both bearing assemblies 94, 96 have press fits to shaft 72. When confronting faces of the two parts 162, 64 close together to capture plug 175 and bearing assembly 94, shaft 72 becomes journaled on opposite wall portions of through-bore 68.

Armature 169 and stator 177 may be assembled into the module either before or after the two parts 162, 64 are brought together and fastened at four corners 191 around their confronting faces. The inner race of bearing assembly 171 is pressed onto shaft 72 after assembly of the armature to the shaft. Electric terminals associated with stator 177 cannot be seen in the Figures, but are present to provide for circuit connection of the motor to an ETC controller, which is also not shown in the drawings, but may be part of an engine management computer. The fastening together of parts 162, 64 includes compressing gasket 116 to seal around through-bore 68 and gasket 46 to seal around passage 114 at split line 179. Throttle position sensor 35 can be assembled to module 160 after parts 162, 64 have been fastened together.

After the assembly of motor 167 has been completed and parts 162, 64 have been fastened together, cover plate 36 is assembled to module 160. The inner face of cover plate 36 has a formation, such as a walled recess 193, for receiving the outer race of bearing assembly 171. Because the bearing assembly's inner race is already pressed to shaft 72, cover plate 36 may be located on the module by fitting recess 193 to the outer race of bearing assembly 171 before fasteners 195 are tightened to secure the cover in place. In that way, the integrity of the alignment of shaft 72 on module 160 already established by bearing assemblies 94, 96 is not impaired by the fastening of cover 36 to throttle body 161. In other words, it is bearing assembly 171 that establishes the precise location of cover plate 36 on the module rather than fasteners 195, and therefore holes in the cover plate with which fasteners 195 are associated are sufficiently large to allow some limited float of the cover plate with respect to the area of throttle body 161 that the plate covers.

By providing suitable features at the interface between walled recess 193 and the outer race of bearing assembly 171, the outer race may be rendered non-rotational within the recess. Material at the interface may be deformed using a suitable process to accomplish this. For example, making cover 36 of a suitable plastic and deforming the receptacle wall in certain appropriate places by a thermal process, such as heat staking, can form the interface to yield the desired non-rotation of the outer bearing race within the walled receptacle.

It is to be appreciated that certain details of the embodiments that do not bear directly on the inventive principles may have been neither specifically illustrated nor explicitly described, and it should be understood that good engineering and manufacturing practices are to be employed in practicing the inventive principles in their application to particular throttle bodies.

While a presently preferred embodiment has been illustrated and described, it is to be appreciated that the invention may be practiced in various forms within the scope of the following claims.

What is claimed is:

1. A throttle for an internal combustion engine air intake comprising a throttle body having a through-bore extending along a longitudinal axis for conducting intake flow from an upstream direction toward a downstream direction, a throttle mechanism for controlling flow through the through-bore and comprising a shaft and an electric motor actuator for turning the shaft to selectively throttle flow through the through-bore; the throttle body further comprising a by-pass air passage for by-passing a region of the through-bore that within which the throttle mechanism throttles the flow, the by-pass air passage comprising an entrance open to the through-bore upstream of the region within which the throttle mechanism throttles the flow and an exit open to the through-bore downstream of the region within which the throttle mechanism throttles the flow, and in which the electric motor actuator has an operative association with the by-pass air passage such that flow through the by-pass air passage cools the electric motor actuator.

2. A throttle as set forth in claim 1 in which a portion of the shaft is disposed external to the through-bore, the electric motor actuator comprises an armature disposed on that portion of the shaft and a stator with respect to which the armature has running clearance, and flow through the by-pass air passage passes axially parallel to the shaft between the stator and the armature.

3. A throttle for an internal combustion engine air intake comprising a throttle body having a through-bore extending along a longitudinal axis for conducting intake flow from an upstream direction toward a downstream direction, a throttle blade disposed within the through-bore on a cylindrical shaft having an axis of turning substantially coincident with a diameter of the through-bore and journaled via bearing assemblies on opposite wall portions of the throttle body for turning about its own axis to selectively position the throttle blade within the through-bore over a range of positions spanning a closed throttle position closing the through-bore to flow and open positions; the throttle body comprising a first body part containing an upstream portion of the through-bore and a second body part containing a downstream portion of the through-bore, the two body parts are joined together to register the downstream portion of the through-bore as a continuation of the upstream portion at respective confronting face portions of the two body parts, including capturing one of the bearing assemblies between the confronting face portions, and another bearing assembly is disposed in a circular aperture in one of the two body parts, and in which the first and second body parts further comprise a by-pass air passage for by-passing a region of the through-bore that contains the throttle blade, the by-pass air passage comprises an upstream portion in the first body part and a downstream portion in the second body part that registers with the upstream portion of the by-pass air passage at further respective confronting face portions of the two body parts, the upstream portion of the by-pass air passage has an entrance open to the upstream portion of the through-bore and an exit at the further confronting face portions, and the downstream portion of the by-pass air passage has an entrance at the further confronting face portions and an exit at the downstream portion of the through-bore.

4. A throttle for an internal combustion engine air intake comprising a throttle body having a through-bore extending along a longitudinal axis for conducting intake flow from an upstream direction toward a downstream direction, a throttle blade disposed within the through-bore on a cylindrical shaft having an axis of turning substantially coincident with a diameter of the through-bore and journaled via bearing assemblies on opposite wall portions of the throttle body for turning about its own axis to selectively position the throttle blade within the through-bore over a range of positions spanning a closed throttle position closing the through-bore to flow and open positions; the throttle body comprising a first body part containing an upstream portion of the through-bore and a second body part containing a downstream portion of the through-bore, the two body parts are joined together to register the downstream portion of the through-bore as a continuation of the upstream portion at respective confronting face portions of the two body parts, including capturing one of the bearing assemblies between the confronting face portions, and another bearing assembly is disposed in a circular aperture in one of the two body parts, and including a third bearing assembly on the shaft located by a formation in a cover plate that is fastened to the body parts.

5. A throttle for an internal combustion engine air intake comprising a throttle body having a through-bore extending along a longitudinal axis for conducting intake flow from an upstream direction toward a downstream direction, a throttle blade disposed within the through-bore on a cylindrical shaft having an axis of turning substantially coincident with a diameter of the through-bore and journaled via bearing assemblies on opposite wall portions of the throttle body for turning about its own axis to selectively position the throttle blade within the through-bore over a range of positions spanning a closed throttle position closing the through-bore to flow and open positions; the throttle body comprising a first body part containing an upstream portion of the through-bore and a second body part containing a downstream portion of the through-bore, the two body parts being joined together to register the downstream portion of the through-bore as a continuation of the upstream portion at respective confronting face portions of the two body parts and journal the shaft on opposite wall portions of the throttle body, including capturing at least one of the bearing assemblies between the confronting face portions; and the first and second body parts further comprising a by-pass air passage for by-passing a region of the through-bore that contains the throttle blade, the by-pass air passage comprising an upstream portion in the first body part and a downstream portion in the second body part that registers with the upstream portion of the by-pass air passage at further respective confronting face portions of the two body parts, the upstream portion of the by-pass air passage having an entrance open to the upstream portion of the through-bore and an exit at the further confronting face portions, the downstream portion of the by-pass air passage having an entrance at the further confronting face portions and an exit at the downstream portion of the through-bore.

6. A throttle as set forth in claim 5 further including respective gasket portions that seal respectively around the through-bore at the confronting face portions where the downstream portion of the through-bore registers with the upstream portion of the through-bore and around the by-pass air passage at the further confronting face portions.

7. A throttle as set forth in claim 5 in which the confronting face portions where the downstream portion of the through-bore registers with the upstream portion of the through-bore are disposed at a first mating plane that perpendicularly intersects the longitudinal axis, and the further confronting face portions are disposed at a second mating plane that is parallel to and spaced axially of the first mating plane.

8. A throttle as set forth in claim 7 in which the second mating plane is spaced axially downstream of the first mating plane.

9. A throttle as set forth in claim 5 further including an air control valve externally mounted on the throttle body and having an operative association with the by-pass air passage for controlling flow through the by-pass air passage.

10. A throttle as set forth in claim 5 in which the throttle body further includes an electric motor actuator for turning the shaft, and the electric motor actuator has an operative association with the by-pass air passage such that flow through the by-pass air passage cools the electric motor actuator.

11. A throttle as set forth in claim 10 in which a portion of the shaft is disposed external to the through-bore, and the electric motor actuator comprises an armature disposed on that portion of the shaft.

12. A throttle as set forth in claim 11 in which the electric motor actuator comprises a stator with respect to which the armature has running clearance, and flow through the by-pass air passage passes axially parallel to the shaft between the stator and the armature.

13. A throttle for an internal combustion engine air intake comprising a throttle body having a through-bore extending along a longitudinal axis for conducting intake flow from an upstream direction toward a downstream direction, a throttle mechanism comprising a blade disposed within the through-bore on a cylindrical shaft having an axis of turning substantially coincident with a diameter of the through-bore and journaled via bearing assemblies on opposite wall portions of the throttle body for turning about its own axis to selectively position the throttle blade within the through-bore over a range of positions spanning a closed throttle position closing the through-bore to flow and open positions; the throttle body comprising a first body part containing an upstream portion of the through-bore and a second body part containing a downstream portion of the through-bore, the two body parts being joined together to register the downstream portion of the through-bore as a continuation of the upstream portion at respective confronting face portions of the two body parts, capturing at least one of the bearing assemblies between the confronting face portions to thereby journal the shaft on opposite wall portions of the throttle body; the first and second body parts further comprising a by-pass air passage for by-passing a region of the through-bore that contains the throttle blade, the by-pass air passage comprising an upstream portion in the first body part and a downstream portion in the second body part that registers with the upstream portion of the by-pass air passage at further respective confronting face portions of the two body parts, the upstream portion of the by-pass air passage having an entrance open to the upstream portion of the through-bore and an exit at the further confronting face portions, the downstream portion of the by-pass air passage having an entrance at the further confronting face portions and an exit at the downstream portion of the through-bore, and in which the further confronting face portions are spaced axially of the confronting face portions where the downstream portion of the through-bore registers as a continuation of the upstream portion of the through-bore.

14. A throttle as set forth in claim 13 in which the confronting face portions where the downstream portion of the through-bore registers with the upstream portion of the through-bore are disposed at a first mating plane that perpendicularly intersects the longitudinal axis, and the further confronting face portions are disposed at a second mating plane that is parallel to and spaced axially of the first mating plane.

15. A throttle as set forth in claim 14 in which the second mating plane is spaced axially downstream of the first mating plane.

16. A throttle as set forth in claim 13 further including an air control valve externally mounted on the throttle body and having an operative association with the by-pass air passage for controlling flow through the by-pass air passage.

17. A throttle as set forth in claim 13 in which the throttle body further includes an electric motor actuator for turning the shaft, and the electric motor actuator has an operative association with the by-pass air passage such that flow through the by-pass air passage cools the electric motor actuator.

18. A method of assembling a throttle for an internal combustion engine air intake, the throttle comprising a throttle body comprising upstream and downstream throttle body parts defining a through-bore extending along a longitudinal axis for conducting intake flow from an upstream direction toward a downstream direction, and a throttle mechanism for controlling flow through the through-bore, the mechanism comprising a shaft, a blade disposed in the through-bore on the shaft, bearing assemblies on the shaft to either side of the blade for journaling the shaft on the throttle body, and an electric motor actuator for turning the shaft to selectively position the blade to throttle flow through the through-bore, the method comprising:

associating the shaft with one body part, including passing the shaft through a circular aperture in one body part to dispose one bearing assembly in that circular aperture, and thereafter associating the two body parts to capture the other bearing assembly between them, and attaching the blade to the shaft.

* * * * *